United States Patent [19]

Flanagan et al.

[11] Patent Number: 4,895,583

[45] Date of Patent: Jan. 23, 1990

[54] APPARATUS AND METHOD FOR SEPARATING AIR

[75] Inventors: Scott Flanagan, Houston, Tex.; Robert A. Mostello, Somerville; Anne P. Ko, Woodcliff Lake, both of N.J.

[73] Assignee: The BOC Group, Inc., Murray Hill, N.J.

[21] Appl. No.: 296,543

[22] Filed: Jan. 12, 1989

[51] Int. Cl.[4] ..... F25S 3/02

[52] U.S. Cl. ..... 62/24; 62/27; 62/36; 62/42

[58] Field of Search ..... 62/11, 24, 27, 36, 42

[56] References Cited

U.S. PATENT DOCUMENTS

| | | | |
|---|---|---|---|
| 3,113,854 | 12/1963 | Bernstein | 62/28 |
| 3,756,035 | 9/1973 | Yearout | 62/24 |
| 4,133,662 | 1/1979 | Wagner | 62/13 |
| 4,137,056 | 1/1979 | Golovko | 62/24 |

*Primary Examiner*—Ronald C. Capossela

*Attorney, Agent, or Firm*—Carol A. Nemetz; R. Hain Swope; Larry R. Cassett

[57] ABSTRACT

Method and Apparatus for separating a gaseous mixture into component gases wherein a portion of a compressed cooled stream of the gaseous mixture is substantially liquefied and respective portions sent to high and low pressure columns and either one of the gaseous components or a portion of the gaseous mixture is utilized for refrigeration from expansion with a portion of the work utilized for compression of the gaseous mixture.

14 Claims, 5 Drawing Sheets

APPARATUS AND METHOD FOR SEPARATING AIR

FIELD OF THE INVENTION

The present invention is generally directed to the separation of gaseous mixtures. In particular, the present invention is directed to apparatus and methods of separating air and recovering oxygen using lower air compressor power consumption.

BACKGROUND OF THE INVENTION

Oxygen production can be achieved by a variety of methods, e.g. distillation, absorption, membrane permeation, chemical reaction and diffusion. Almost all of these methods have been applied only to small scale oxygen production. For reasons of practicality and economic feasibility, air distillation is the only method currently employed to produce large quantities of oxygen having sufficient purity for commercial use such as in a coal gasification plant.

The apparatus used for the production of gaseous oxygen by air distillation generally is divided into five major zones. An air compression zone is utilized to compress air from atmospheric pressure to higher pressures needed for subsequent processing. An impurity removal zone is employed to remove water, carbon dioxide, hydrocarbons, and other impurities to thereby provide a highly pure air stream.

A third zone cools the air to its condensation temperature and recovers refrigeration through the expansion of gas by the use of heat exchangers. Through the use of a series of fractionation columns, the air is distilled in a fourth zone into the oxygen product and nitrogen waste. Finally, a fifth zone is employed to compress the oxygen product to the delivery pressure required by the end user.

One such system is described in Bernstein, U.S. Pat. No. 3,113,854 incorporated in its entirety herein by reference. Pressurized air is sent to a condenser to obtain a liquid/gas air product which is then fractionated in a high pressure column to produce a crude liquid oxygen product and relatively pure nitrogen gas. The crude liquid oxygen is sent to a low pressure fractionation column to obtain an oxygen product which is then warmed to ambient temperature and pressurized according to commercial requirements.

One aspect of the Bernstein process is to remove the liquid oxygen from the low pressure column and forward the same to the air condenser. The liquid oxygen is vaporized in the air condenser and a portion of the gaseous oxygen is used as reboil for the low pressure column.

Bernstein also provides for the controlled removal of a liquid material from the low pressure column for use in a reboiler to effect liquefaction of a high pressure gaseous nitrogen stream originating from the high pressure column. In addition, Bernstein provides refrigeration by expansion with work of a portion of the high pressure nitrogen gas using an expansion engine or turboexpander. In accordance with the Bernstein improvements of the conventional two fractionation zone separation system, the energy for air compression is significantly reduced.

However, the Bernstein process is able to obtain recoveries of pure oxygen greater than about 95 percent when the nitrogen flow to the turboexpander for refrigeration is less than 10 percent of the feed air, a value achievable only in the very largest plants. Considering the vast amount of pure oxygen needed for commercial applications, where flows to the turboexpander will be greater than about 10 percent, improving oxygen recovery remains a necessary and desirable goal in the industry. In addition, there is a need to operate an oxygen recovery system in which oxygen can be readily delivered over a range of pressures without utilizing an oxygen compressor; or where the feed gas to an oxygen compressor is at a pressure higher than that at which it could be delivered from low pressure column pressure. Such an improved method, and apparatus therefor is provided in accordance with the present invention.

SUMMARY OF THE INVENTION

The present invention is directed to a method for efficiently separating a gaseous mixture into its component parts and particularly to the separation of air to yield oxygen at low power consumption. This is in part due to the substantially complete liquefaction of a portion of the air feed and the subsequent feeding of respective portions of the liquid air to high and low pressure fractionating means to convert oxygen therein to a liquid and to emit nitrogen as a gas.

More specifically, the process of the present invention is directed to the production of oxygen by the separation of air which comprises:

(a) separating air which has been compressed and cooled into first and second portions;

(b) liquefying substantially all of the first portion and introducing a first part thereof and the second portion into a high pressure fractionating means to obtain a crude liquid oxygen stream and substantially pure gaseous nitrogen;

(c) introducing the second part of the first portion of liquid air formed in step (b) into a low pressure fractionating means to obtain a substantially pure gaseous nitrogen product and a substantially pure liquid oxygen stream, wherein the crude liquid oxygen stream produced in step (b) is introduced into the low pressure fractionating means at an intermediate stage;

(d) condensing the substantially pure gaseous nitrogen formed in step (b) in heat exchange with a boiling liquid withdrawn from an intermediate stage in the low pressure fractionating means, introducing a portion of the resulting liquid nitrogen to each of the high and low pressure fractionating means as reflux and returning the resulting vapor to the low pressure fractionating means;

(e) forming substantially pure gaseous oxygen from the liquid stream formed in step (d) by heat exchange with the first portion of cooled, compressed air being liquefied in step (b); and (f) withdrawing substantially pure oxygen gas as product, wherein the ratio of the liquid air introduced into the high pressure fractionating means to the liquid air introduced into the low pressure fractionating means is from about 1:9 to 1:1.

As a result of the present invention, oxygen recovery has been increased to better than 95% percent of the oxygen contained in the feed air over a range of turboexpander flows and plant sizes heretofore not possible.

BRIEF DESCRIPTION OF THE DRAWINGS

The following drawings in which like reference characters indicate like parts are representative of embodiments of the invention and are not intended to limit the scope of the invention as encompassed by the claims of the application.

DETAILED DESCRIPTION OF THE INVENTION

In accordance with the present invention, the substantially complete condensation of a portion of the cooled air provides a system in which the oxygen product exiting the system may be delivered over a range of pressures by adjusting the condensed air pressure without substantial energy losses when the liquefied air is reduced in pressure before entry into the distillation columns.

Thus, if the desired oxygen pressure does not exceed the bottom stage pressure of the low pressure column and if two air compressors are used, the air compressor supplying air to the condenser may be operated at a lower discharge pressure than the compressor supplying air directly to the high pressure column. It is within the scope of the present invention to deliver oxygen at the desired pressure by boosting the pressure of the air to be condensed, which in turn, allows the oxygen to boil at a higher temperature and pressure (i.e., supercharging the oxygen product). This operation is accomplished without the use of an oxygen compressor as would be required in conventional systems.

In addition, the energy output of an expander used for plant refrigeration may be employed to further compress the air being sent to the air condenser which allows the oxygen to boil at a higher pressure. This enables the main air compressor to operate at a lower discharge pressure required by the high pressure column while increasing the pressure of the delivered oxygen gas and reducing the number of primary air compressors to one.

The overall power reduction benefit of the present invention over systems such as that described in Bernstein, U.S. Pat. No. 3,113,854, is more apparent in plants where the turboexpander flow in moles/hr is greater than 10 percent of the plant feed air in moles/hr. Turboexpander flows of this magnitude occur in intermediate size plants (150 to 1500 short tons of oxygen per day) and in plants of any size where some liquid product is made.

Table 1 shows a comparison of oxygen recoveries form the oxygen content of the plant feed air for production of an oxygen product containing 95 percent oxygen by volume:

TABLE 1

| Turboexpander Flow as % of the Air | Oxygen Recovery % | | |
|---|---|---|---|
| | U.S. Pat. No. 3,113,854 | Present Invention Nitrogen expansion | Present Invention Air expansion |
| 7.4 | 96.9 | 99.7 | 99.7 |
| 13 | 91 | 97 | 98 |
| 20 | 84 | 92 | 96 |

Figure 1:
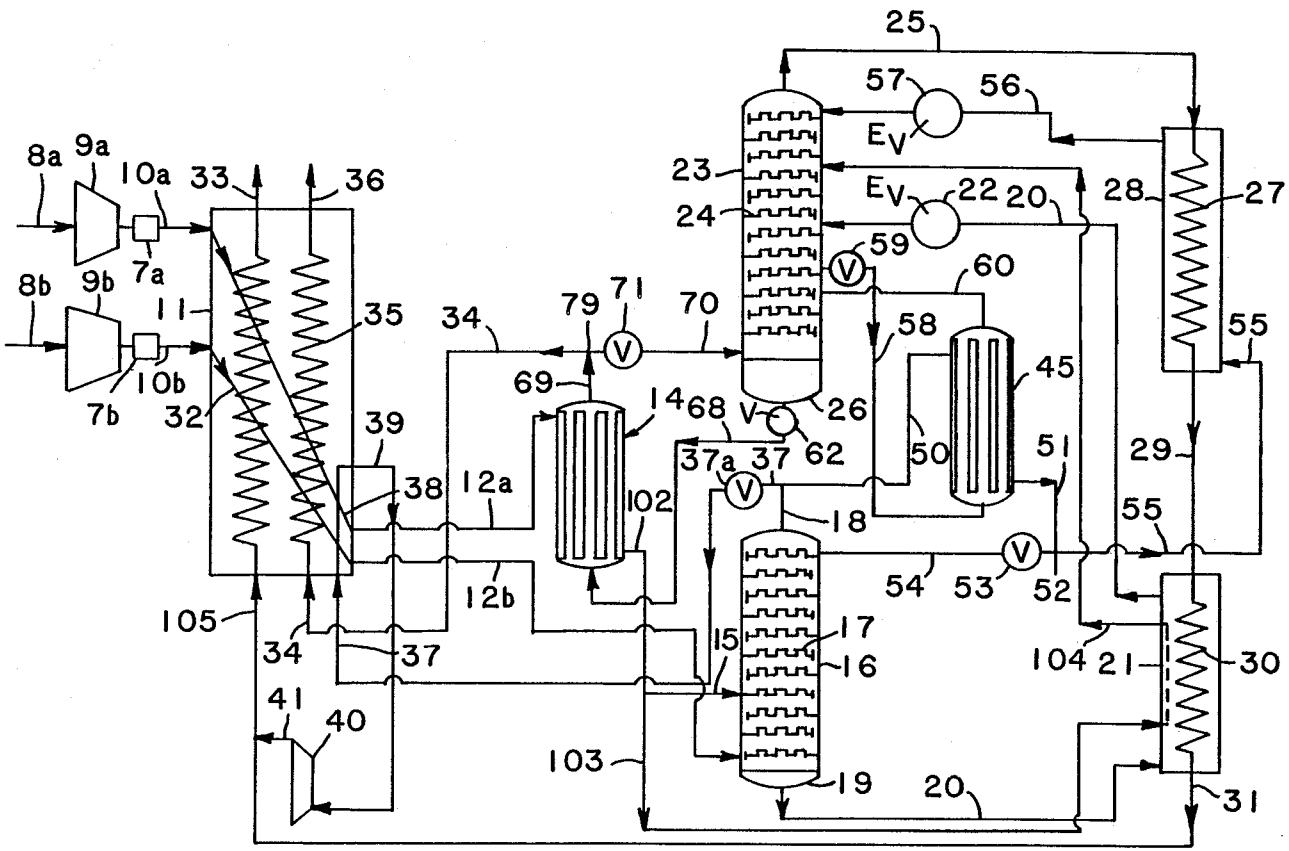
FIG. 1 is a schematic view of one embodiment of the invention showing dual air feeds to a heat exchanger, a liquid stream obtained from an air condenser being split with respective portions flowing to high and low pressure columns, and nitrogen expansion providing refrigeration.

The present invention will now be described with reference to the drawings. Referring to the drawings and particularly to FIG. 1, there are disclosed embodiments of the invention particularly suited for the recovery of oxygen from air.

As shown, separate atmospheric air streams at 8*a* and 8*b* are compressed in corresponding compressors 9*a* and 9*b*, and after cooling, the air flows are treated to remove impurities, principally water and carbon dioxide, typically via known adsorbent bed systems, represented by numerals 7*a* and 7b, respectively.

The pressurized air from the compressor 9*a* and adsorber 7*a* are fed through a conduit 10*a* into a heat exchanger 11 where the air flows in countercurrent relationship to oxygen and nitrogen as described hereinafter and is thereby cooled to about its dew point.

The cooled air exits the heater exchanger 11 and flows through a conduit 12*a* into an air condenser 14 where, in accordance with one of the features of the invention, substantially all of the air is liquefied. The amount of air which is condensed or liquefied is in the range of about 25 to 50%, preferably 35 to 40% of the total air feed which is compressed.

The liquid air exits the bottom of the air condenser 14 via a conduit 102. The condensed air stream is then split. One portion flows through a conduit 15 into a high pressure fractionating means such as a high pressure column 16. The other portion of the stream is sent through a conduit 103 to a subcooler 21. The subcooled air then flows through a conduit 104 to a low pressure fractionating means such as a low pressure column 23.

The ratio of the amount of the condensed air sent to the high pressure column 16 to the amount of the condensed air delivered to the low pressure column 23 is in the range of about 1:9 to 1:1, preferably about 1:5 to 1:3. The portion of the condensed air which is sent to the low pressure column 23 is delivered to the section of the column 23 where the ratio of nitrogen to oxygen in the downcoming liquid is substantially similar to the ratio of nitrogen to oxygen in the liquid air stream when it is flashed to the lower pressure of the low pressure column 23. The portion of the condensed air sent to the high pressure column 16 is delivered to the section of the column 16 where the ratio of nitrogen to oxygen in the downcoming liquid is substantially similar to the ratio of nitrogen to oxygen in the air. The air from the compressor 9*b* and adsorber 7*b* flows through the conduit 10*b* into the heat exchanger 11 and is brought to a temperature near its dew point as it passes in heat exchange relationship with an oxygen product stream 36 and a nitrogen stream 33. All of the air flowing through the conduit 10*b* passes out of the heat exchanger 11 via a conduit 12*b* and is fed directly to the high pressure column 16.

The high pressure column 16 and the low pressure column 23 are typical of distillation column designs used in low temperature processing composed of stacked separating plates for countercurrent flow of liquid and vapor streams with mass transfer between them. The air vapor stream entering the high pressure column 16 via the conduit 12*b*, and the condensed air entering the high pressure column via the conduit 15, undergo separation into a substantially pure gaseous nitrogen low boiling fraction which exists the high pressure column 16 through a conduit 18 and a liquid stream, termed rich liquid or crude oxygen, exiting in the conduit 20. The gaseous nitrogen stream is split with the major portion thereof going to a nitrogen condenser 45 (i.e. an intermediate reboiler of the low pressure column) via a conduit 50 to provide refrigeration for the process and the minor portion returning to the heat exchanger 11 via conduit a 37.

The minor high pressure nitrogen stream enters a passageway 38 which may be located at the cold end of the heat exchanger 11 and is warmed therein before exiting the heat exchanger 11 via the conduit 39. The warmed nitrogen stream is sent to a turboexpander 40 to provide refrigeration, and emerges therefrom via a conduit 41 to merge with the gaseous nitrogen product passing from a subcooler 21 via a conduit 105. The gaseous nitrogen product is then passed through the heat exchanger 11 for discharge or collection out of the conduit 33.

The major portion of nitrogen gas exiting the high pressure column 16 through the conduit 18 enters the nitrogen condenser 45. The high pressure nitrogen gas is liquefied in the nitrogen condenser 45 and then withdrawn as reflux liquid nitrogen via a conduit 51 where it is divided at point 52. One portion flows through a conduit 55 to a subcooler 28 where it is cooled by countercurrent flow in a passageway 27 with nitrogen gas obtained from the low pressure column 23 via a conduit 25. The nitrogen reflux from the conduit 55 is forwarded through a conduit 56 and is expanded through a valve 57 to the upper region of the low pressure column 23. The other portion of the high pressure nitrogen gas is delivered in metered amounts through a valve 53 via a conduit 54 as a reflux to the high pressure column 16.

The gaseous nitrogen condensing in the nitrogen condenser 45 vaporizes the oxygen rich liquid stream containing about 50 to 85 mole % of oxygen, preferably about 75 to 80 mole %, in separate passages of the nitrogen condenser 45, which are in thermal contact with the nitrogen passages. The oxygen rich liquid stream is obtained from the low pressure column 23 via a valve 59 and a conduit 58.

The vaporized material flows through a conduit 60 to an area of the low pressure column 23 where the column vapor composition is similar, which is below the point where the oxygen rich liquid is removed from the low pressure column 23.

Liquid oxygen product is withdrawn from the pool 26 at the bottom of the low pressure column 23 and sent via a conduit 68 and a valve 62 to the air condenser 14. The liquid oxygen is evaporated in heat exchange with the portion of the relatively warm air feed which condenses after entering the air condenser 14 through the conduit 12*a*. The vaporized substantially pure oxygen is withdrawn through a conduit 69 which is divided at a point 79. One portion flows through a conduit 70 to the low pressure column 23 above the oxygen pool 26 to provide reboil. A valve 71 is provided to regulate the flow of oxygen which can be at higher pressure than the pressure of the low pressure column 23. The other portion flows through the conduit 34 as oxygen product gas into the passageway 35 of the heat exchanger 11 and is collected out of a conduit 36.

The liquid high boiling fraction in the form of rich liquid (or crude oxygen) in the high pressure column 16 collects in a pool 19 in the bottom of the column 16. The crude oxygen is withdrawn from the high pressure column 16 via a conduit 20 and after flowing through the subcooler 21 and an expansion valve 22 is introduced at an intermediate feed point in a low pressure fractionating zone of the low pressure column 23.

As previously indicated, gaseous nitrogen is conducted by the conduit 25 from the low pressure column 23 through a passageway 27 of the subcooler 28 and then by a conduit 29 through a passageway 30 of the subcooler 21. The gaseous nitrogen flows into the conduit 31 and then directly into the conduit 105.

Oxygen can be delivered efficiently over a range of pressures by supercharging the oxygen (i.e. by boiling oxygen at higher pressures against higher pressurized air from the compressor 9*a* which elevates the condensing air temperature) as a result of the substantially complete condensation of a portion of the total air feed in the air condenser 14.

Figure 2:
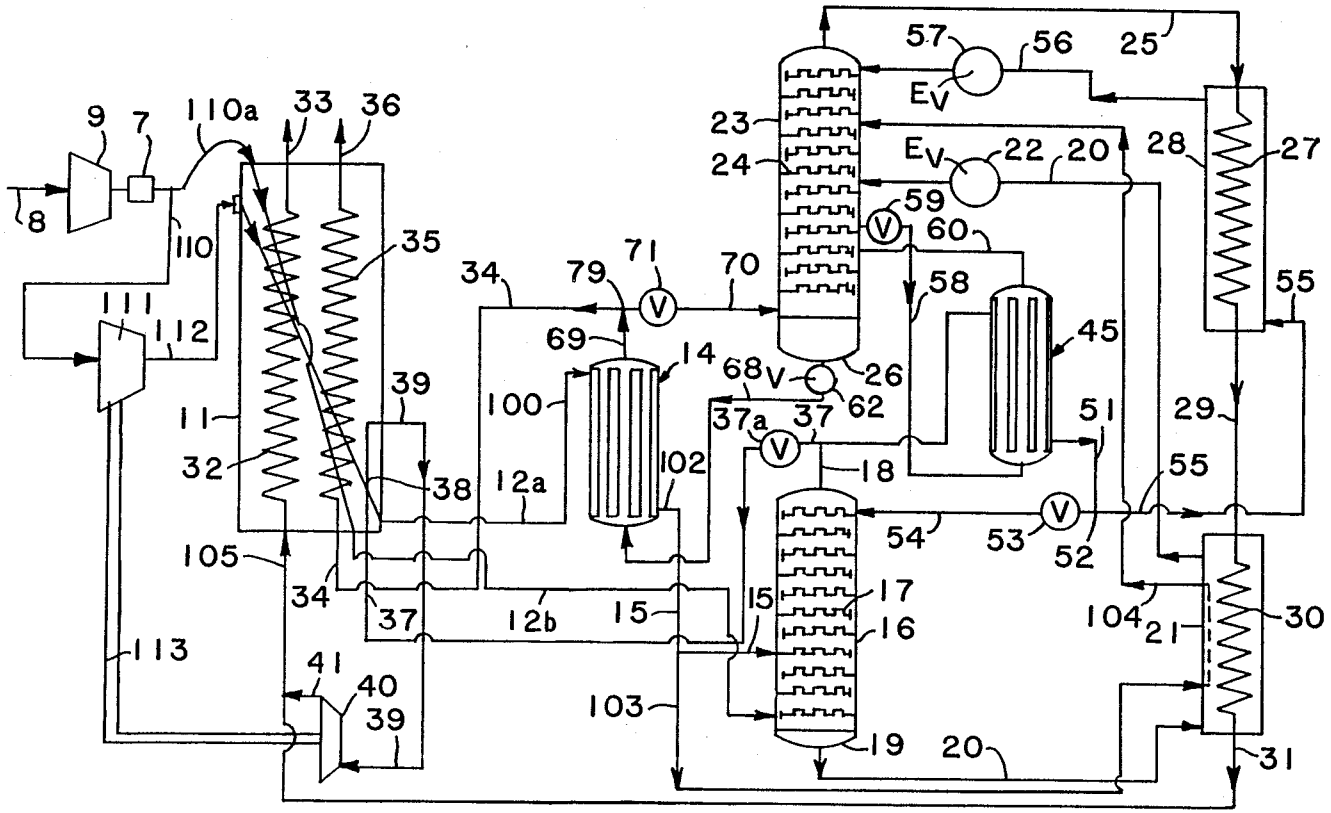
FIG. 2 is a schematic view of another embodiment of the invention employing a single air compressor and nitrogen expansion for refrigeration and utilizing shaft energy from a nitrogen expander to provide booster compression of part of the air.

The embodiment shown in FIG. 2 provides a system in accordance with the invention in which nitrogen expansion is used for refrigeration and in which shaft energy therefrom is directly connected to an air compressor.

More specifically, air from a conduit 8 is compressed in the air compressor 9 and purified in the adsorber system 7. The compressed air is split with a major portion being sent via a conduit 110*a* through the heat exchanger 11 directly through a conduit 12*b* into the high pressure column 16. The remaining minor portion of the compressed air is sent via a conduit 110 to a second air compressor 111 where the air is further compressed. The compressed air is passed via a conduit 112 where it is cooled to its dew point in the heat exchanger 11 and passed via the conduit 12*a* to the air condenser 14. The compressor 111 utilizes the work output from nitrogen expansion performed in the expander 40 which is connected via a shaft 113 to the compressor 111. Preferably, the portion of the substantially pure gaseous nitrogen expanded in turbo expander 40 exceeds 10 percent of the total air compressed.

This embodiment of the invention enables product oxygen to be delivered at higher pressures (e.g. about 8 to 12 psig) economically since only a minor portion of the air is supercharged by the work output from the expander 40. The structure of the compressor - expander combination utilized in this embodiment is more fully explained in U.S. Pat. No. 4,133,662, incorporated herein by reference.

Figure 3:
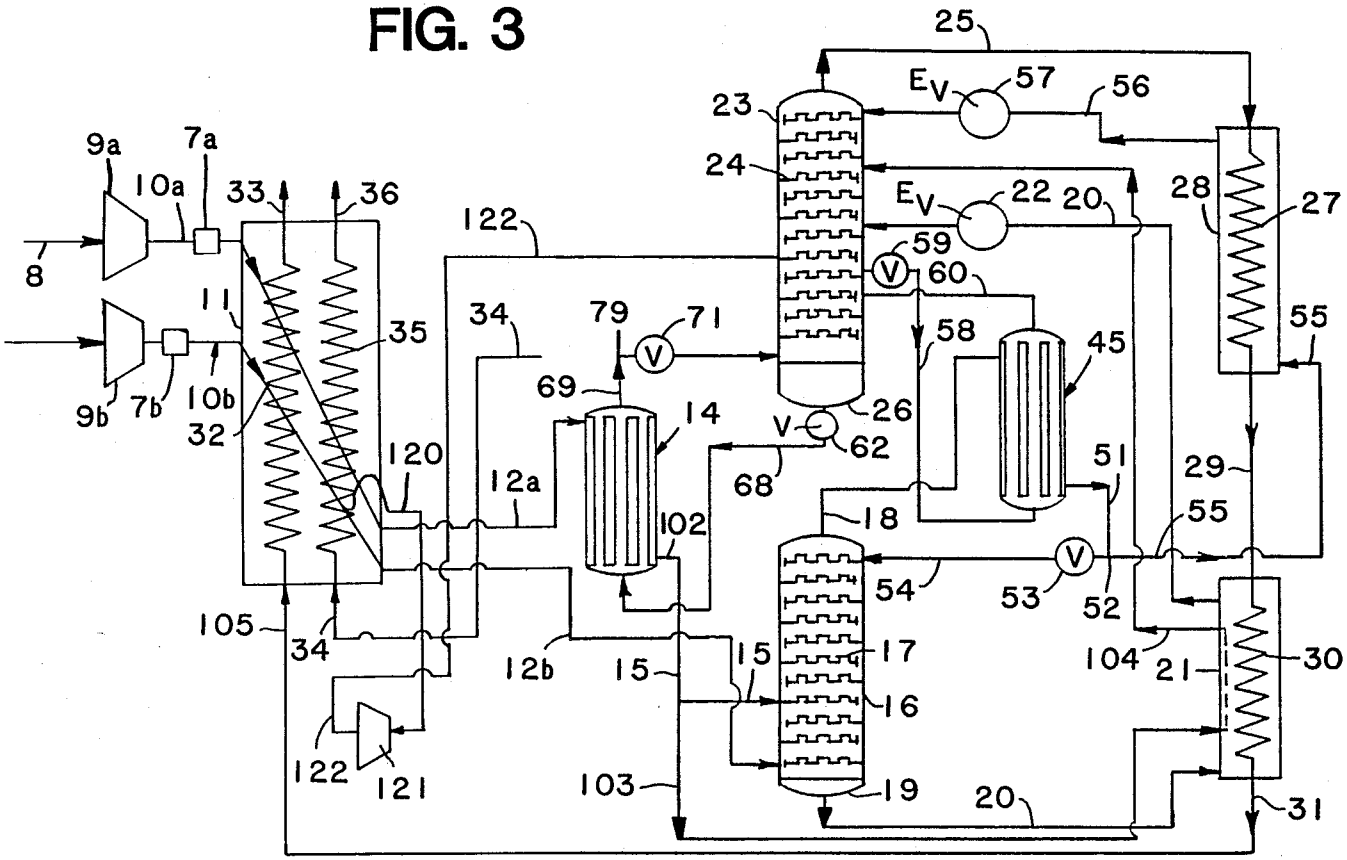
FIG. 3 is a schematic view of another embodiment of the invention similar to FIG. 1 using air expansion to provide refrigeration.

The embodiment shown in FIG. 3 employs air expansion to supply refrigeration in a system similar to that of FIG. 1 and similar to the modifications of compression and purification apparatus discussed in connection with FIG. 1.

Air is fed from the compressor 9*a* and the purification system 7*a* through the heat exchanger 11 via the conduit 12*a* to the air condenser 14 where substantially all of the air is liquefied. A second air stream is sent to a compressor 9*b*. The compressed air is passed through the purification system 7*b* and sent via the conduit 10*b* through the heat exchanger 11. The resulting cooled air is sent to the high pressure column 16 via the conduit 12b. A portion of the cooled air is sent via a conduit 120 to an expander 121 where it is expanded to provide refrigeration for the process. The expanded air is sent from the expander 121 via a conduit 122 to the low pressure column 23 at a position above the point that liquid material is removed via the conduit 58.

Figure 4:
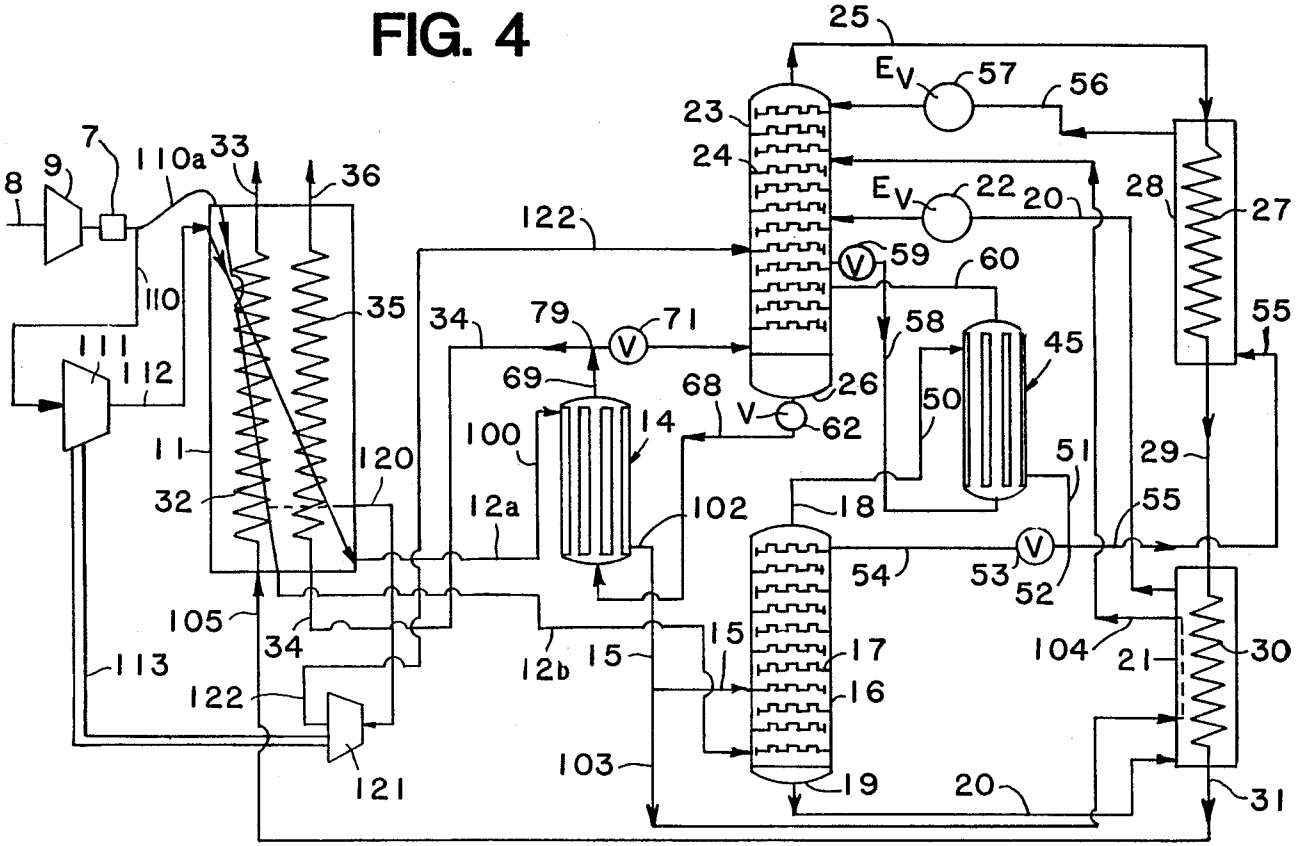
FIG. 4 is a schematic view of a further embodiment of the invention similar to FIG. 3 using air expansion to provide refrigeration and shaft energy from the air expander to provide booster compression of part of the air.

In a further embodiment as shown in FIG. 4, air expansion is used for refrigeration in a system similar to the one shown in FIG. 2. Compressed air from the compressor 9 passes through adsorber system 7 and is split with a major portion being sent via the conduit 110a through the heat exchanger 11 via the conduit 12b into the high pressure column 16. A side stream of the cooled air is sent via the conduit 120 to the expander 121 where it is expanded to provide refrigeration for the process and wherein the work output is sent via the shaft 113 to be used to drive the compressor 111.

As explained in connection with FIG. 2, the second compressor 111 sends more highly compressed air via the conduit 112 to the heat exchanger 11 for eventual delivery via the conduit 12a to the air condenser 14.

Figure 5:
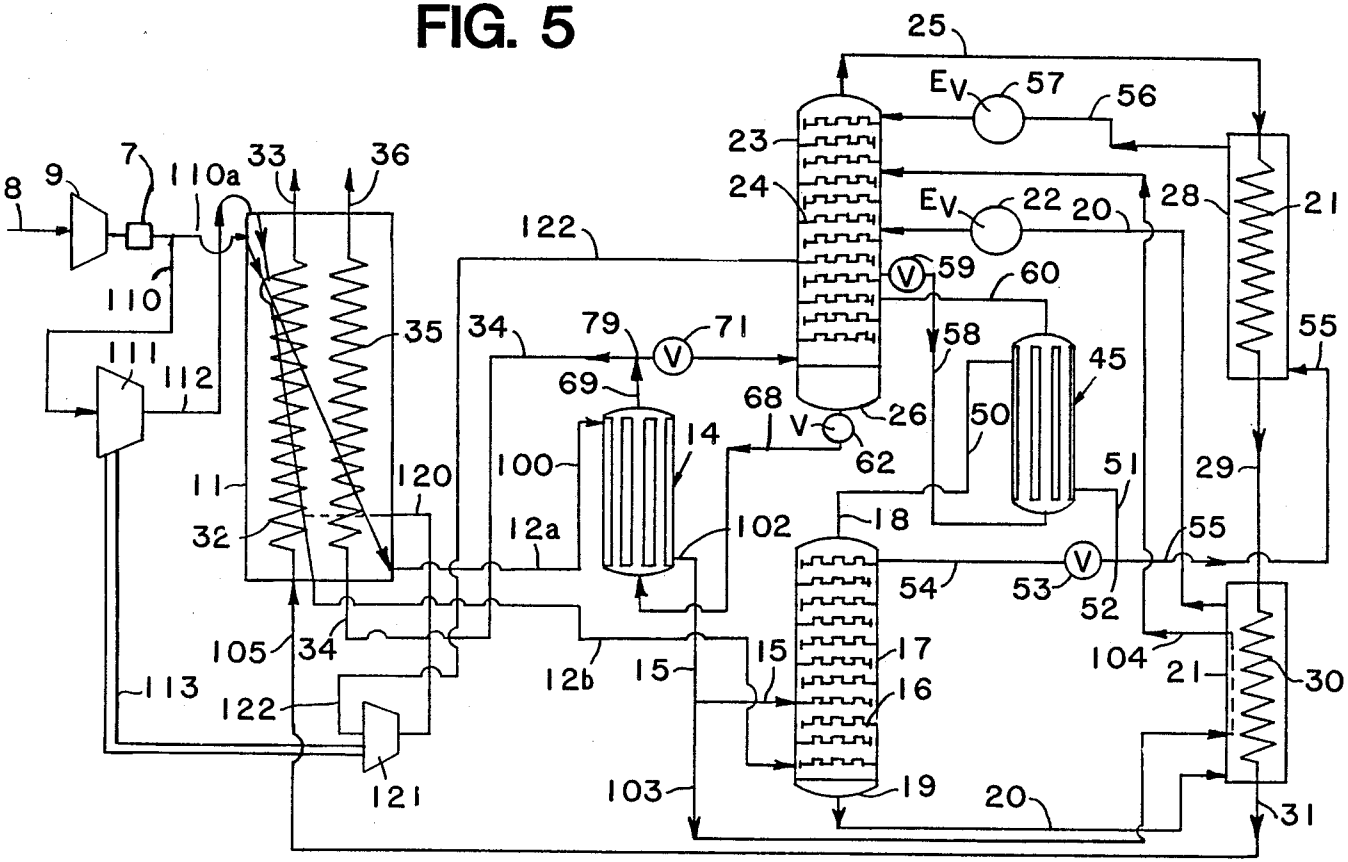
FIG. 5 is a schematic view of another embodiment of the invention in which a second compressor is used to compress the air being fed to the high pressure column.

In a still further embodiment as shown in FIG. 5, air being sent to the high pressure column 16 is compressed in both compressors 9 and 111. This system is employed when the required delivery pressure for the gaseous oxygen product is low. More specifically, compressed air from the compressor 9 is passed through the absorber system 7 and then split. A major portion of the compressed air stream is sent via conduit 110 to the compressor 111 and sent via the conduit 112 to the heat exchanger 11. A portion of the cooled air is sent via the conduit 120 to the turbo expander 121 while the major portion of the cooled air is sent via the conduit 12b to the high pressure column 16.

The remaining compressed air exiting the absorber system 7 enters the heat exchanger 11 from the conduit 110a with further compression and proceeds to the air condenser 14 where the air is liquefied while liquid oxygen boils at a pressure below the pressure required for boiling in the embodiment shown in FIG. 4.

EXAMPLE

By way of example and referring in particular to FIG. 1, 1600 moles/hr of air is fed via the conduit 8a into the compressor 9a where the air is compressed to 65.3 psia at 85° F. while 2550 moles/hr of air is fed via the conduit 8b to the compressor 9b and compressed to 71 psia at 85° F. The respective air stream pass through the purification units 7a and 7b for removal of water and carbon dioxide. However, other arrangements for the compression and purification may be utilized as discussed previously.

The first compressed air stream is fed via the conduit 10a to the heat exchanger 11 and emerges via the conduit 12a at a pressure of 63.3 psia and a temperature of −282.7° F. The entire cooled first air stream enters the condenser 14 where it is substantially liquefied and enters the conduit 102 at a temperature of −290° F.

A minor portion of the liquefied air (375 moles/hr) is sent via the conduit 15 to the high pressure column 16. The major portion of the liquefied air (1225 moles/hr) is sent via the conduit 103 to the subcooler 21 and emerges from the conduit 104 at a pressure of 63.3 psia and a temperature of −294° F. The liquefied air stream is then sent to the low pressure column 23.

The second compressed air stream enters the heat exchanger 11 via the conduit 10b and emerges from the heat exchanger 11 via the conduit 12b at a pressure of 68 psia and a temperature of −282.7° F. and is fed to the lower section of the high pressure column 16. Crude liquid oxygen is withdrawn from the pool 19 in the high pressure column 16, and flows via the conduit 20 at the rate of 1495 moles/hr at a pressure of 68 psia and a temperature of −284° F. to the subcooler 21 where the crude oxygen is subcooled to a temperature of −294° F. The subcooled oxygen flows via the conduit 20 through the expansion valve 22 into the low pressure column 23.

Subcooling of the above-described liquid air and crude liquid oxygen in the subcooler 21 is the result of the flow of waste nitrogen from the top of the low pressure column 23. More specifically, nitrogen gas is emitted from the top of the low pressure column 23 at the rate of 2,890 moles/hr at a pressure of 18.7 psia and a temperature of −316.4° F. and flows via the conduit 25 through the subcooler 27 and via the conduit 29 at a pressure of 18.2 psia and a temperature of −303° F. into the subcooler 21. The lower temperature nitrogen gas cools both the liquefied air and the crude liquid oxygen so that the nitrogen gas exits the subcooler 21 at a reduced pressure and temperature (17.9 psia; −290.1° F.). The nitrogen gas then flows via the conduit 31 where it joins nitrogen gas (17.8 psia; −249° F.) from the expander 40 through conduit 41. This combined nitrogen stream flows at the rate of 3,240 moles/hr via the conduit 105 through the passageway 33 of the heat exchanger 11 where it cools the compressed air streams 10a and 10b. The nitrogen gas exits the heat exchanger 11 at about atmospheric pressure and a temperature of 80° F.

The top of high pressure column 16 emits nitrogen gas via the conduit 18 at the rate of 2,750 moles/hr at a pressure of 66.5 psia and a temperature of −292° F. A portion of the nitrogen gas is directed via the conduit 37 through the expansion valve 37a to the heat exchanger 11 for cooling the compressed air streams. The reduced temperature nitrogen gas is sent to the expander 40 via the conduit 39 at a pressure of 64.8 psia and a temperature of −180° F., is expanded to about 18 psia and −240° F. and is then combined with the nitrogen gas in the conduit 31.

The second portion of the nitrogen gas from the top of the high pressure column 16 flows via the conduit 50 to the nitrogen condenser 45 and a portion exits as a liquid reflux via the conduit 51. The liquid nitrogen (1320 moles/hr) is returned to the high pressure column 16 via the conduit 54 and through the expansion valve 53. The nitrogen vapor coming from the conduit 51 flows through the conduit 55 at a pressure of 66.5 psia and a temperature −292° F. into the subcooler 28 where it heats the waste nitrogen gas entering the subcooler 28 via the conduit 25.

The cooled nitrogen reflux exits the subcooler 28 via the conduit 56 at the rate of 1,080 moles/hr at a temperature of −312° F. and flows through the expansion valve 57 into the upper region of the low pressure column 23.

The bottom of the low pressure column 23 emits liquid oxygen from the pool 26 which flows through the valve 62 via the conduit 68 at the rate of 1,275 moles/hr (20.5 psia; −293° F.) to the air condenser 14. A portion of the liquid oxygen is recycled as reboil to the low pressure column 23 via conduit 69, valve 71 and conduit 70 at the rate of 365 moles/hr (20.5 psia; −292° F.). A major portion is sent via the conduit 34 from a dividing point 79 to a passageway 35 of the heat exchanger 11.

Purified oxygen product is collected from the line 36 at the rate of 907 moles/hr (19 psia; 80° F).

The low pressure column 23 emits a liquid stream containing about 77% oxygen at the rate of 1,830 moles/hr (20 psia; −300° F.) via the conduit 58 and the valve 59 to the nitrogen condenser 45. A gaseous mixture (20 psia; −295° F.) is returned from the top of the nitrogen condenser 45 via the conduit 60.

It will be understood that the particular arrangements of compressors and purification systems are only representative of a number of arrangements, some of which are more practical from cost and operating standpoints. For instance, all the air can be compressed in a single compressor to a pressure at which purification takes place, and which may be the final pressure of part of the air, while the remainder of the air is further compressed to a higher pressure required by the process. Alternatively, it may become practical to modify process conditions to merge the required discharge for both air streams so that the streams are divided only after passing through heat exchanger 11.

What we claim is:

1. A process for the production of oxygen by the separation of air comprising:

(a) separating air which has been compressed and cooled into first and second portions;

(b) liquefying substantially all of the first portion and introducing a first part thereof and the second portion into a high pressure fractionating means to obtain a crude liquid oxygen stream and substantially pure gaseous nitrogen;

(c) introducing the second part of the first portion of liquid air formed in step (b) into a low pressure fractionating means to obtain a substantially pure gaseous nitrogen product and a substantially pure liquid oxygen stream, wherein the crude liquid oxygen stream produced in step (b) is introduced into the low pressure fractionating means at an intermediate stage;

(d) condensing the substantially pure gaseous nitrogen formed in step (b) in heat exchange with a boiling liquid withdrawn from an intermediate stage in the low pressure fractionating means, introducing a portion of the resulting liquid nitrogen to each of the high and low pressure fractionating means as reflux and returning the resulting vapor to the low pressure fractionating means;

(e) forming substantially pure gaseous oxygen from the liquid stream formed in step (d) by heat exchange with the first portion of cooled, compressed air being liquefied in step (b); and (f) withdrawing said substantially pure oxygen gas as product, wherein the ratio of the liquid air introduced into the high pressure fractionating means to the liquid air introduced into the low pressure fractionating means is from about 1:9 to 1:1.

2. A process in accordance with claim 1, wherein a portion of the substantially pure gaseous oxygen formed in step (e) is returned to the low pressure fractionating means as reboil.

3. A process in accordance with claim 1, wherein a portion of the substantially pure gaseous nitrogen formed in step (b) is expanded to provide refrigeration for the process.

4. A process in accordance with claim 3, wherein the gaseous nitrogen is expanded in a turbo expander and the energy provided thereby is utilized to compress air for separation.

5. A process in accordance with claim 4, wherein the portion of the substantially pure gaseous nitrogen expanded in the turbo expander exceeds 10 percent of the total air compressed.

6. A process in accordance with claim 1, wherein the ratio of the liquid air introduced into the high pressure fractionating means to the liquid air introduced into the low pressure fractionating means is from about 1:5 to 1:3.

7. A process in accordance with claim 1, wherein the first portion of air formed in step (a) is further compressed prior to being liquefied.

8. A process in accordance with claim 1, wherein said first portion of air liquefied in step (b) comprises from about 25 to 50 percent of the total air compressed.

9. A process in accordance with claim 8, wherein said first portion of air liquefied in step (b) comprises from about 35 to 40 percent of the total air compressed.

10. A process in accordance with claim 1, wherein step (a), the air is separated into said first and second portion prior to being compressed.

11. A process in accordance with claim 1, wherein air is separated into said first and second portions prior to being compressed and cooled.

12. A process in accordance with claim 1, wherein a part of the second portion of air formed in step (a) is expanded to provide refrigeration for the process and then introduced into the low pressure fractionating means.

13. A process in accordance with claim 12, wherein the air is expanded in a turbo expander and the energy provided thereby is utilized to compress air for separation.

14. A process in accordance with claim 1, wherein the second portion of air formed in step (a) is further compressed prior to being introduced into the high pressure fractionating means.

* * * * *